US005111173A

United States Patent [19]

Matsuda et al.

[11] Patent Number: 5,111,173

[45] Date of Patent: May 5, 1992

[54] DEFLECTION ELECTROMAGNET FOR A CHARGED PARTICLE DEVICE

[75] Inventors: Tetsuya Matsuda; Shunji Yamamoto; Tadatoshi Yamada; Toshie Ushijima, all of Amagasaki, Japan

[73] Assignee: Mitsubishi Denki Kabushiki Kaisha, Japan

[21] Appl. No.: 578,790

[22] Filed: Sep. 7, 1990

[30] Foreign Application Priority Data

Mar. 27, 1990 [JP] Japan ..... 2-75582

[51] Int. Cl.[5] ..... H01F 1/00; H01F 7/00; H01H 5/00; H05H 13/04

[52] U.S. Cl. ..... 335/216; 335/213; 328/235

[58] Field of Search ..... 335/210, 213, 299, 216; 328/235

[56] References Cited

U.S. PATENT DOCUMENTS

| | | | |
|---|---|---|---|
| 4,680,565 | 7/1987 | Jahnke | 335/216 |
| 4,734,653 | 3/1988 | Jahnke . | |
| 4,737,727 | 4/1988 | Yamada | 335/216 |
| 4,740,758 | 4/1988 | Ries . | |
| 4,780,683 | 10/1988 | Nakata | 328/235 |

FOREIGN PATENT DOCUMENTS 2223350 4/1990 United Kingdom .

OTHER PUBLICATIONS

Jahnke et al., "First Superconducting Prototype Magnets For A Compact Synchrotron Radiation Source In Operation", IEEE Transactions on Magnetics, vol. 24, No. 2, Mar. 1988, pp. 1230-1232.

Journal de Physique, Tome 45, Colloque C1, Supplement AU No. 1, Jan. 1984, pp. C1-255 through C1-258.

*Primary Examiner*—Leo P. Picard
*Assistant Examiner*—Ramon M. Barrera
*Attorney, Agent, or Firm*—Leydig, Voit & Mayer

[57] ABSTRACT

Semicircular superconducting deflection magnets for deflecting electron beams along a semiconductor orbit. The magnet 1 comprises a pair of race-track shaped main coils 2 and 3 disposed symmetrically with respect to the plane of the orbit S. Each one of the main coils 2 and 3 is divided into two parts 21 and 22 or 31 and 32, the end portions 21*a* and 22*a* or 31*a* and 32*a* being displaced from each other in the direction of the orbit S, so that the magnetomotive force thereof is distributed evenly along the orbit S (FIGS. 12 through 14). According to another aspect, rectangular cancellation coils 25, 26, 35, and 36 are provided at the end portions 21*a*, 22*a*, 31*a*, and 32*a*, respectively, of the coil parts 21, 22, 31, and 32, such that the magnetomotive force of each one of the end portions is cancelled by the magnetomotive force of the adjacent parallel running side of a cancellation coil (FIGS. 21 through 23). According to still another aspect, sextupole correction coils 5 are disposed near the end portions 2*a* of the main coils 2 along the orbit S.

10 Claims, 18 Drawing Sheets

$W_1 = W_2$
$y_1 \neq y_2$ $W_1 \neq W_2$
$y_1 = y_2$

DEFLECTION ELECTROMAGNET FOR A CHARGED PARTICLE DEVICE

BACKGROUND OF THE INVENTION

This invention relates to deflection electromagnets for charged particle devices such as synchrotrons, and more particularly to structures of superconducting coils of 180 degrees bending magnets by which a magnetic field of improved homogeneity can be produced.

Charged particle devices are becoming increasingly important not only for research but also for industrial application purposes. For example, synchrotrons are now attracting attention as light sources in the x-ray lithography field for the production of VLSI circuits. Such synchrotrons generally comprise a pair of 180 degree bending or deflection magnets. Let us first describe the overall structure of a typical superconducting deflection magnet referring to FIGS. 1 and 2, which show the perspective and the plan view of the magnet, respectively:

The deflection electromagnet 1 comprises an upper and a lower main coil 2 and 3, each being formed of a racetrack shaped coil bent into a semi-circular form. Currents flow in the upper and lower coils 2 and 3 in the same direction shown by the arrows m1 and m2, respectively, so as to produce a magnetic field perpendicular to the plane of the orbit S of the charged particles (electrons). (The direction perpendicular to the plane of the orbit is shown at Z in FIG. 1.) Thus, the electrons, travelling along the equilibrium orbit S in the direction indicated by the arrows thereon, are deflected by the magnetic field generated by the main coils 1 and 2, so as to follow the circular path along the orbit S.

In order that the electrons are deflected properly along the orbit S, it is necessary that the magnetic field generated by the coils 2 and 3 is uniform in the order of $1\times10^{-4}$ to $1\times10^{-3}$ along the radial direction R perpendicular to the orbit S. If the magnetic field near the orbit S is not uniform, the electron beam traveling along the equilibrium orbit S is increasingly deviated therefrom and eventually is lost when the deviation becomes so large that the beam hits the vacuum chamber wall (not shown). Thus, a magnetic field must be produced which is uniform in the direction R along the whole semicircular length of the orbit S.

The magnetic field produced by the main coils 2 and 3, however, includes quadrupole and sextupole, etc., as well as bipolar field components, so that the magnetic field varies linearly and quadratically, etc., along the radial direction R perpendicular to the orbit S. Thus, shim coils are sometimes used as correction coils for these quadrupole and sextupole field components contained in the field generated by the main coils 2 and 3. However, such shim coils, which can be easily attached to near the middle of the semicircular main coils 2 and 3 (i.e., near $\Theta=0$ in FIG. 2), are difficult to attach to the end portions 2*a* and 3*a* of the main coils 2 and 3, since there is little room left there for attachment. Hence, a large error magnetic field (i.e., the field components which vary along the radial direction which is difficult to correct is generated near the end portions 2*a* and 3*a* of the main coils 2 and 3.

The error field generated near the end portions 2*a* and 3*a* of the main coils 2 and 3 consists primarily of sextupole component. Let us explain this by referring to FIG. 3 which shows the variation of the magnetic field $B_z$ along the radial direction R near the end portions 2*a* and 3*a* of the coils 2 and 3. The magnetic field generated by the coils 2 and 3 can be regarded as a composition of the fields generated by the inner and outer branches 2*b*, 2*c*, 3*b* and 3*c* of the coils 2 and 3 (see FIG. 1). Thus, the field $B_z$ is at its maximum at $R=0$ where the radial direction R intersects the electron orbit S. As the absolute value of R increases from zero (i.e., as the radial distance from the orbit S increases), the magnetic field $B_z$ decreases, such that when R increases beyond the radial length corresponding to the inner branches, 2*b* and 3*b*, or outer branches, 2*c* and 3*c*, of the coils 2 and 3, the field $B_z$ takes a negative value since the inner branches 2*b* and 3*b* or outer branches 2*c* and 3*c* of the coils 2 and 3 form a magnetic field directed opposite to the field generated near the orbit S. Near the end portions 2*a* and 3*a* of the coils 2 and 3, the radial separation between the inner and outer branches of the coils 2 and 3 is smaller than near the middle of the coils 2 and 3 (near $\Theta=0$); hence, the negative second order, or sextupole, component becomes especially conspicuous near the end portions 2*a* and 3*a* of the coils. Thus, as shown in FIG. 3, the variation of the magnitude of the field $B_z$ with respect to R near the end portions 2*a* and 3*a* of the coils is represented essentially by a quadratic curve which has its maximum at $R=0$ where the radial direction R crosses the orbit S. On the other hand, the sextupole field component is negligible on the orbit S at positions far away from the end portions 2*a* and 3*a* of the coils. FIG. 4 shows the variation of the magnitude of the sextupole component (in teslas per square meters) along the orbit S, starting from $\Theta=0$ degrees (at the middle of the coils 2 and 3) and ending just beyond $\Theta=90$ degrees (the end portions 2*a* and 3*a* of the coils).

As pointed out above, this sextupole component, which is conspicuous near the end portions 2*a* and 3*a* of the coils and has an adverse effect on the stability of the electron beam, cannot readily be corrected by means of shim coils, since there is little room for the attachment of the shim coils near the end portions 2*a* and 3*a* of the coils.

The magnetic field generated by the coils 2 and 3 near the end portions 2*a* and 3*a* thereof contains other multipolar components as well as the predominant sextupole components explained above. FIG. 5 shows a form of the main coils 2 and 3 of the deflection magnet disclosed in Japanese patent application laid-open (Kokai) No. 63-221598, which is intended for suppressing the non-uniform or error components of the magnetic field. The side view of the magnet of FIG. 5 is shown in FIG. 6. As shown clearly in FIG. 6, the end portions 2*a* and 3*a* of the coils 2 and 3 are bent away from the plane of the orbit S (i.e., the midplane of the deflection magnet with respect to which the coils 2 and 3 are disposed symmetrically); this design is intended for improving the uniformity of the magnetic field near the ends of the coils 2 and 3. The angle $\alpha$ of the bent end portions 2*a* and 3*a* with respect to the plane of the orbit S is selected at 30 degrees$\pm$15 degrees (i.e., from 15 to 15 degrees). (By the way, as shown in FIG. 6, the inner branch 2*b* and 3*b* of the coils 2 and 3 are nearer to the plane of the orbit S than the outer branches 2*c* and 3*c*; this design is effective in suppressing the quadrupole component, which, however, is not directly relevant to the present invention.)

The magnet design of FIGS. 5 and 6 is effective to a certain degree in enhancing the uniformity of the magnetic field; however, it still suffer from the following disadvantages. Namely, since the structure of the coils 2 and 3 are complicated, especially at the bent end portions 2*a* and 3*a* thereof, the critical current of the coils 2 and 3 at which the transition from the superconduction to the normal conduction of the coils takes place becomes smaller; thus, it becomes infeasible to produce a magnetic field of a greater magnitude which is necessary for obtaining high energy electrons. Further, the production procedures become complicated and hence the production cost is increased. It is further also noted as a disadvantage of the coil design of FIGS. 5 and 6 that, although the uniformity of the magnetic field is increasingly enhanced as the angle $\alpha$ of the bent end portions 2*a* and 3*a* approaches 90, the inherent difficulty in bending the superconducting coils limits the bending angle; thus, the uniformity of the field cannot be enhanced beyond a certain level.

Superconducting deflection magnets are accompanied with difficulties other than the non-uniformity of the magnetic field pointed out above. Namely, the strength of the magnetic field which acts on the superconducting coils takes its maximum value near the end portions thereof, and the maximum field acting on the coils limits the maximum current which may flow through the coils without destroying the superconductivity thereof.

FIGS. 7 through 9 show the coil structure which is effective in suppressing the maximum value of the magnetic field which acts on the superconducting coils 2 and 3; this coil structure is disclosed, for example, in A. Jahnke et al.: "First superconducting prototype magnets for a compact synchrotron radiation source in operation", IEEE transactions on magnetics, vol. 24, No. 2, pp. 1230 through 1232, March 1988.

As shown in FIGS. 7 and 8, the end portions of the upper superconducting coil 2 are each divided into three parts 2A, 2B, and 2C, separated by spacers 4 from each other; the end portions of the lower coil 2 are divided into three parts 3A, 3B, and 3C, separated by spacers 4 from each other. The sum of the widths of these divided parts is substantially equal to the width of the non-divided portions of the coils 2 and 3. The spacers 4 are made, for example, of GFRP (glass fiber reinforced plastic). The electron beams are represented at points E on the orbit S in FIGS. 7 and 8; further, the vertical projections onto the orbit S of the central positions of the divided parts of the coils 2 and 3 and those of the spacers 4 are represented by successive points S1 through S5 thereon, the overall width of the end portions of the coils 2 and 3 being represented by W.

Let us explain the necessity of suppressing the maximum field applied on the superconducting coils by reference to FIG. 10, wherein B-I (magnetic field v. current) characteristic curve C represents the typical relation between the magnetic field B (plotted along the abscissa in T (teslas)) and the maximum current I (plotted along the ordinate in A (amperes)) which may flow through a short linear superconducting material without destroying the superconductivity thereof: when the current I exceeds the level represented by the characteristic curve C, the transition from the superconduction to the normal conduction takes place. The load curve $B_0$ of the central magnetic field, i.e., the field $B_0$ at the representative location at which the magnetic field is utilized (that is, a point on the orbit S in the case of the magnet of FIGS. 7 through 9, which is at the center of symmetry of the magnet), represents the relation between the magnitude of the current I and the magnetic field $B_0$ generated there. The load curve Bmax1 represents the relation between the current I and the maximum magnetic field Bmax1 applied on the superconducting coils in the case where the coil ends are divided as shown in FIGS. 7 and 8; on the other hand, the load curve Bmax2 represents the relation between the current I and the maximum magnetic field Bmax2 applied on the superconducting coils in the case where the coil ends are not divided.

As shown by the curve C in FIG. 10, the maximum current which may flow through the superconducting coils without destroying the superconductivity thereof decreases as the magnetic field applied on the coils increases. On the other hand, the maximum magnetic field applied on the superconducting coils, Bmax (Bmax1 or Bmax2), is generated at a place where the radius of curvature of the coils is small and the magnetomotive forces generated by the coils are thus concentrated. Thus, the maximum field Bmax2 acting on the coils with divided ends is generated near the points a in FIG. 8 in the case of the coils of FIGS. 7 and 8, where the curvature of the coils 2 and 3 is at its smallest. The maximum field Bmax1 acting on the coils with undivided ends is generated near the analogous points corresponding to the points a.

The operation of coils with undivided ends may be summarized as follows. Since a small current produces a large maximum magnetic field Bmax1 at the undivided coil ends, the curve Bmax1 has a smaller inclination than the curve Bmax2. At I=350 A (amperes), the load curve Bmax1 intersects the B-I characteristic curve C in FIG. 10; this means that current exceeding 350 amperes flowing through the linear superconducting material destroys the superconductivity thereof. Generally speaking, the performance of the superconducting coils deteriorates below the level represented by the characteristic curve C (which represents the characteristic of a short linear material) in the cource of production thereof. Thus, the operating point P on the load curve Bmax1 is selected at about 80 percent of the current level of the point at which the load curve Bmax1 intersects the characteristic curve C. As shown by the dotted lines extending horizontally from the operating point P and then vertically downward from the curve $B_0$ in FIG. 10, the central magnetic field $B_0$ generated at the operating point P is about 1.6 T (teslas).

Compared with the maximum field Bmax1, the maximum field Bmax2 acting on the coils with divided ends is suppressed, as shown by the curve Bmax2 having a larger inclination in FIG. 10. Assuming that the operating point Q on the curve Bmax2 is selected at about 80 percent of the level of the intersection point of the curves Bmax2 and C as in the case of the coils with undivided ends, the central magnetic field $B_0$ generated at the operating point Q becomes as great as about 2.1 T, as shown by the dotted lines extending from Q.

From the above discussion, it can be concluded that the more the maximum magnetic field Bmax acting on the coils is suppressed and is thus reduced nearer to the level of the central magnetic field $B_0$, the stronger becomes the central magnetic field $B_0$ that can be produced without destroying the superconductivity of the coils.

Referring to FIG. 8 of the drawings, let us now explain the mechanism by which the maximum field Bmax2 acting on the coils with divided ends is suppressed. The end parts 2A, 2B, and 2C of the upper coil 2, or those 3A, 3B, and 3C of the lower coil 3, are separated from each other by inserted spacers 4, which support the electromagnetic forces acting between these parts. Thus, with respect to direction of the orbit S, although magnetomotive forces are present at points S1, S3, and S5 thereon, no magnetomotive force is present at points S2 and S4, above and below which the spacers 4 are disposed. The magnetomotive forces generated at the ends of the coils are thus dispersed, and hence the maximum field Bmax acting on the coils is suppressed. This is the mechanism by which the maximum field Bmax acting on the coils with divided ends is suppressed.

Thus, the suppression of the maximum field Bmax on the coils by means of the divided ends as shown in FIGS. 7 and 8 has the following disadvantages. When the width W of the end portions of the coils 2 and 3 is given as an imposed condition, it is ideal to divide the end portions of the coils into infinitely many parts. In reality, however, the number of division is limited (e.g., to three, as shown in FIGS. 7 and 8) by practical difficulties in the production of the coils. Although division into three parts, for example, shown in FIGS. 7 and 8, is effective in suppressing the maximum field Bmax, the suppressive effect cannot exceed a certain limit imposed by the number of division.

Further disadvantages result from the division of coil ends as shown in FIGS. 7 and 8: FIG. 11 shows the magnetic field strength B, obtained by theoretical calculations, along the orbit S near the end portions of the coils. Compared with the case of the field B1 (represented by a dotted curve) generated by the coils with undivided ends, the variation region of the field B2 (represented by a solid curve) generated in the case where the coil ends are divided is spread over a greater length along the orbit S, since the electromotive force of the divided coil ends is dispersed over a wider region along the orbit S. The variation of the field B2 generated by coils with divided ends is uneven, since the field B2 is weakened on the orbit S at positions where spacers 4 are disposed thereabove and therebelow and, hence, no magnetomotive force is present. The uneven variation of the field over a long region along the orbit S may have adverse effects on the stability of the electron beam, because a precise adjustment of the field over the long variation range of the field along the orbit S is essential for proper deflection of the electron beams.

SUMMARY OF THE INVENTION

Thus, a first object of this invention is to provide a superconducting deflection magnet for defecting charged particle beams (e.g., electron beams) along a semicircular orbit, wherein the maximum magnetic field which acts on the coils in operation is effectively suppressed, while even and smooth distribution of the field near the end portions of the coils is achieved.

A second object of this invention is to provide a superconducting deflection magnet for deflecting charged particle beams along a semicircular orbit, wherein the radial uniformity of the magnetic field near the beam orbit is enhanced by means of a simple coil assembly which is easy to produce and whose production does not involve complicated bending steps which substantially reduce the maximum current that can flow through the coils without destroying coil superconductivity.

The first object is accomplished according to the principle of this invention in a deflection magnet which comprises a race-track shaped upper and lower superconducting coil bent into a semicircular form along the semicircular orbit and disposed symmetrically with respect to the plane of the orbit of the charged particle beam. The race-track shaped upper and lower coils include: radially inner and outer semicircular branches running parallel to the semicircular orbit, and end portions bridging the radially inner and outer branches. Each one of the end portions of the upper and lower coils is divided at least into two parts which are displaced from each other in the direction of the orbit. Preferably, the magnetomotive force of the end portions of he upper and lower coils is distributed evenly along the direction of the orbit.

The second object is accomplished according to the principle of this invention by a deflection magnet which comprises: race-track shaped main coils bent into a semicircular form along the semicircular orbit and disposed symmetrically with respect to the plane of the orbit of the charged particle beam, said race-track shaped main coils including end portions bridging radially inner and outer semicircular branches thereof running parallel to the semicircular orbit; and rectangular cancellation coils each provided at one of said end portions of the main coils, each cancellation coil having a side running parallel and adjacent to one of the end portions of the main coils, the plane of each one of the cancellation coils forming a substantial angle to the plane of the orbit, wherein the direction and magnitude of current flowing in each one of the cancellation coils is such that the magnetomotive force of the current flowing through the side of each cancellation coil that is parallel and adjacent to an end portion of the main coils is equal in magnitude and opposite in direction to the magnetomotive force of a current flowing through the end portion.

The second object of this invention is also accomplished by a deflection magnet which comprises: race-track shaped main coils bent into a semicircular form along the semicircular orbit and disposed symmetrically with respect to the plane of the orbit of the charged particle beam, said race-track shaped main coils including end portions bridging radially inner and outer semicircular branches thereof running parallel to the semicircular orbit; and multipolar correction coils each disposed near one of the end portion of the main coils along the orbit of the charged particle, such that an integral of a multipolar magnetic field component, generated by the main coils and the correction coils, along the orbit of the charged particle beam vanishes. Preferably, the multipolar correction coils consist of sextupole correction coils.

BRIEF DESCRIPTION OF THE DRAWINGS

The novel features which are believed to be characteristic of this invention are set forth with particularity in the appended claims. This invention itself, however, both as to its structure and method of operation, together with further objects and advantages thereof, may best be understood from the detailed description of the preferred embodiments, taken in connection with the accompanying drawings, in which:

FIGS. 7 through 9 show a structure of a conventional superconducting magnet having divided end portions, wherein FIG. 7 shows a plan view, FIG. 8 a section along line VIII—VIII, and FIG. 9 a section along IX—IX of the magnet;

FIGS. 12 through 14 show a magnet according to a first embodiment of this invention, wherein FIG. 12 is a plan view, FIG. 13 a sectional view along line XIII—XIII, and FIG. 14 a sectional view along line XIV—XIV of the magnet;

FIGS. 21 through 23 show another magnet according to this invention which comprises cancellation coils, wherein FIG. 21 is a plan view, FIG. 22 a sectional view along line XXII—XXII, and FIG. 23 a sectional view along line XXIII—XXIII of the magnet;

FIGS. 26 through 28 show still another magnet according to this invention which comprises cancellation coils, wherein FIG. 26 is a plan view, FIG. 27 a sectional view along line XXVII—XXVII, and FIG. 28 a sectional view along line XXVIII—XXVIII;

In the drawings, like reference numerals represent like or corresponding parts.

DETAILED DESCRIPTION OF THE PREFERRED EMBODIMENTS

Let us now describe the embodiments of this invention. Since the fundamental structure and method of operation of these embodiments are similar to those of the deflection magnets described above in the introductory portion, the description hereinbelow is limited for the main part to the features which characteristic of this invention; for the overall organization of the magnet, reference should be made to the above description in the introductory part.

Figure 12:
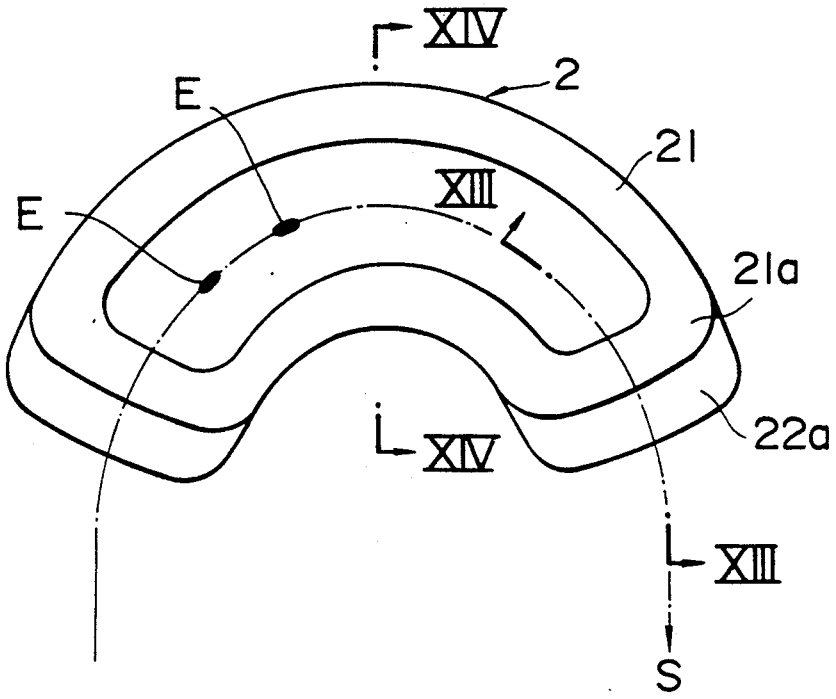
Figure 13:
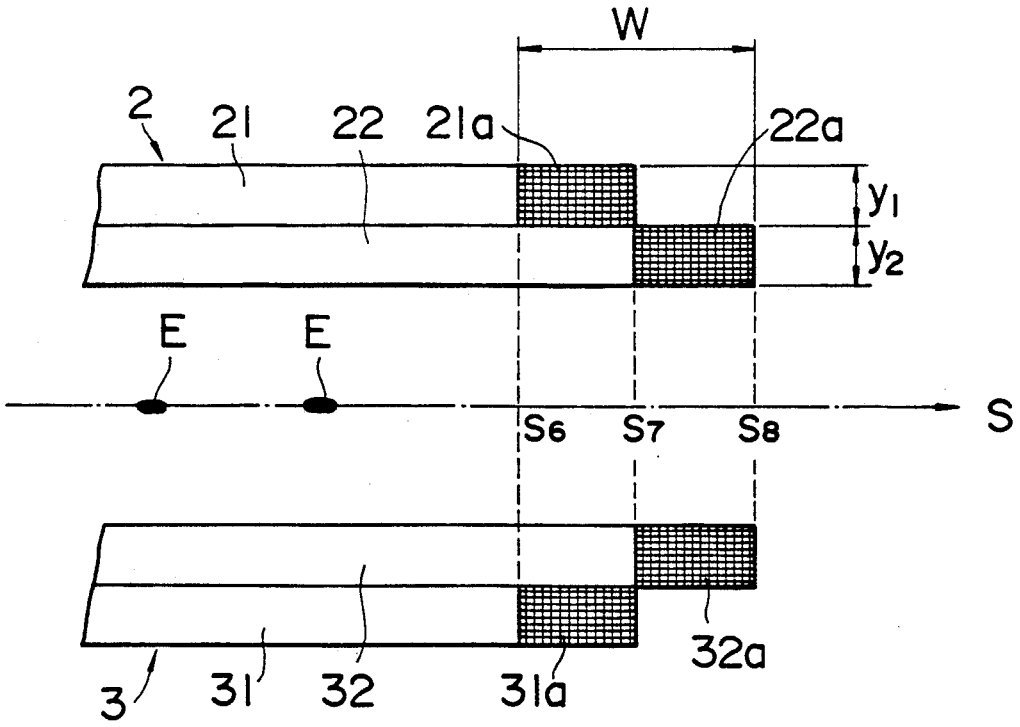
Figure 14:
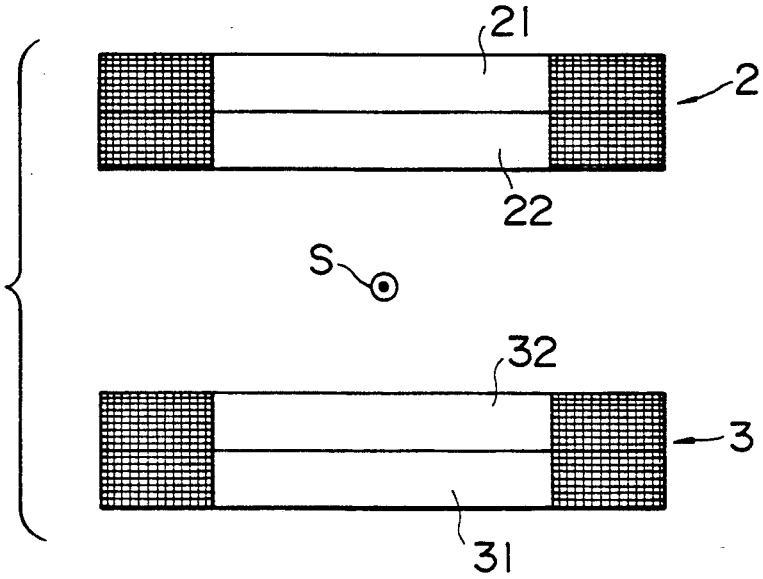

FIG. 12 through 14 shows a first embodiment. The upper and lower main coils 2 and 3, disposed symmetrically with respect to the plane of the orbit S along which the electron beams E are deflected, are each divided into two coil parts, 21 and 22, and 31 and 32, through a plane parallel to the plane of the orbit S. As shown clearly in FIGS. 12 and 13, the end portions 21*a* and 22*a* of the coil parts 21 and 22 of the upper main superconducting coil 2 are displaced from each other in the direction of the orbit S, such that the end portions 21*a* and 22*a* do not overlap each other in the direction of the orbit S; similarly, the end portions 31*a* and 32*a* of the coil parts 31 and 32 of the lower main coil 3 are displaced in the direction of the orbit S, such that the end portions 31*a* and 32*a* do not overlap each other in the direction of the orbit S. The end portions 21*a* and 31*a* of the coil parts 21 and 31 are positioned vertically farther away from the orbit S and situated to the inner side, in the direction of the orbit S, of the end portions 22*a* and 32*a* of the coil parts 22 and 32 positioned vertically nearer to the orbit S. The windings of the end portions 21*a* and 31*a* of the outer coil parts 21 and 31 extend from point S6 to point S7 along the orbit S, while the windings of the end portions 22*a* and 32*a* of the inner coil parts 22 and 32 extend from point S7 to point S8 along the orbit S. The widths of the end portions of the coil parts, (S7 - S6) and (S8 - S7), are equal to each other in the case of this embodiment: (S7 - S6)=(S8 - S7). The thicknesses of the coil parts, y1 and y2, are also equal to each other: y1=y2. Thus, the end portions 21*a*, 22*a*, 31*a*, and 32*a* have an identical rectangular cross sectional form.

Figure 7:
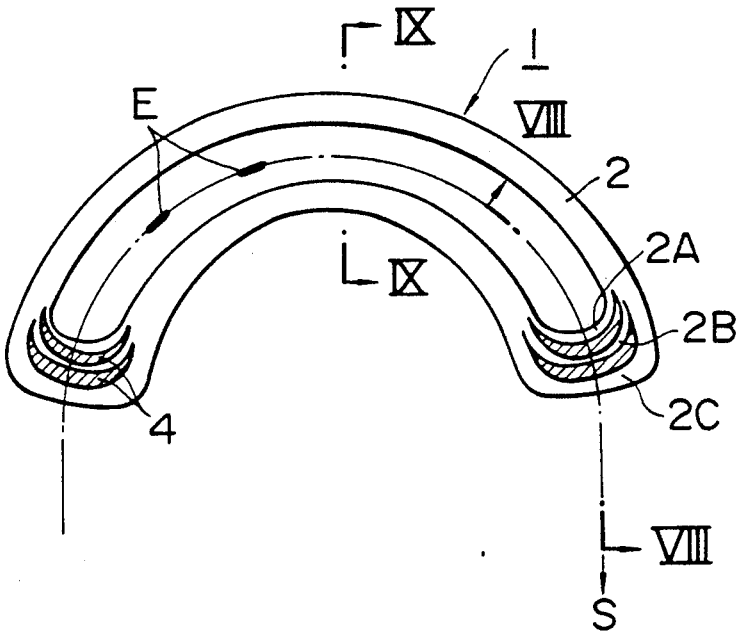
FIG. 7 PRIOR ART
Figure 8:
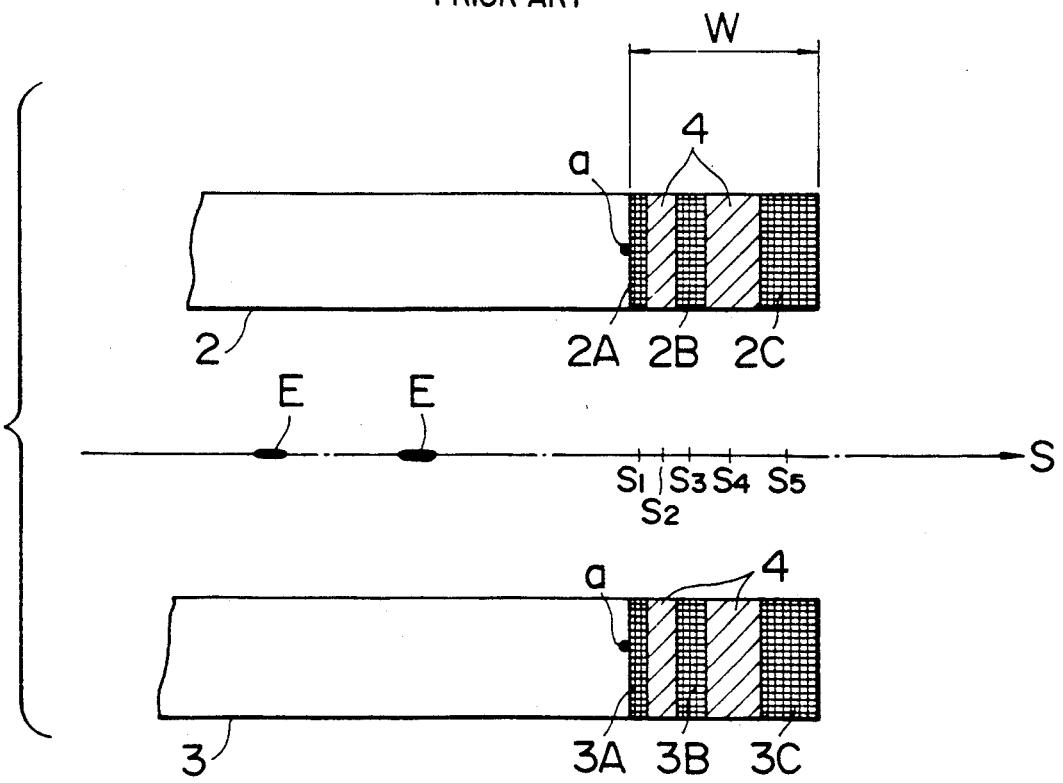
FIG. 8 PRIOR ART
Figure 9:
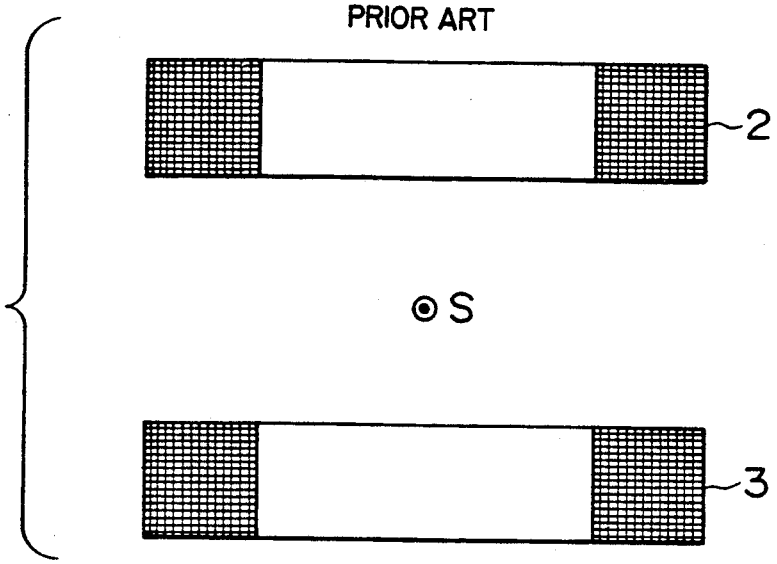
FIG. 9 PRIOR ART
Figure 10:
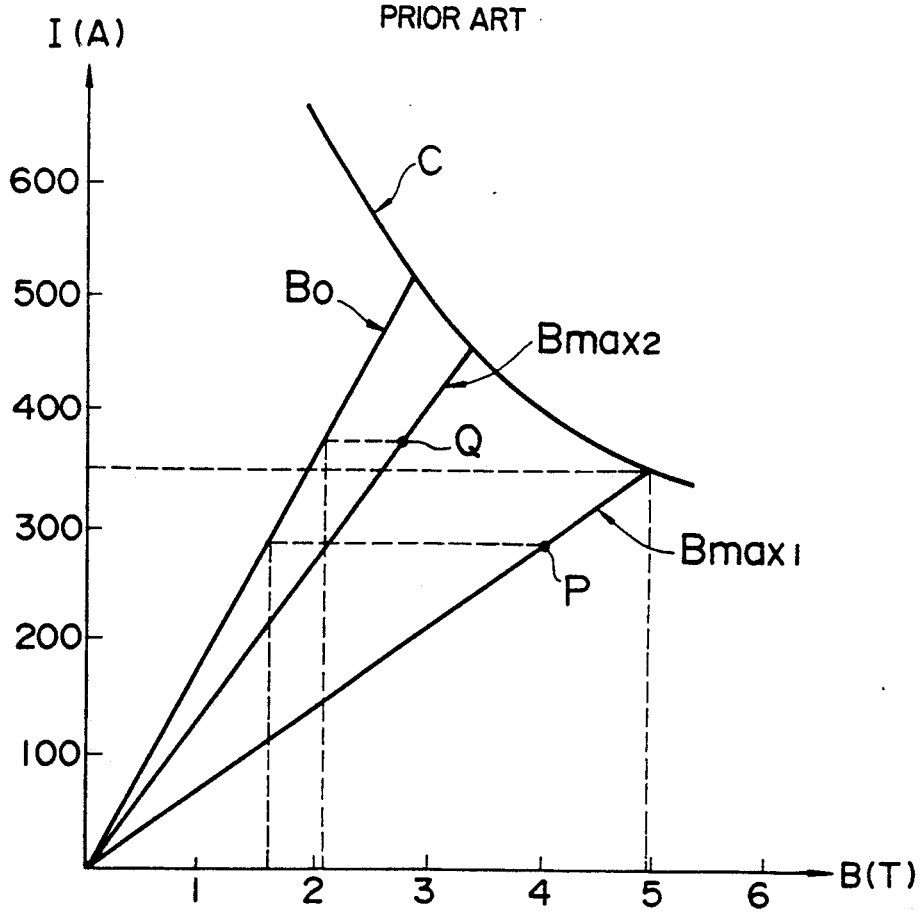
FIG. 10 PRIOR ART
FIG. 10 shows a typical B-I characteristic of a short linear superconducting material.
Figure 11:
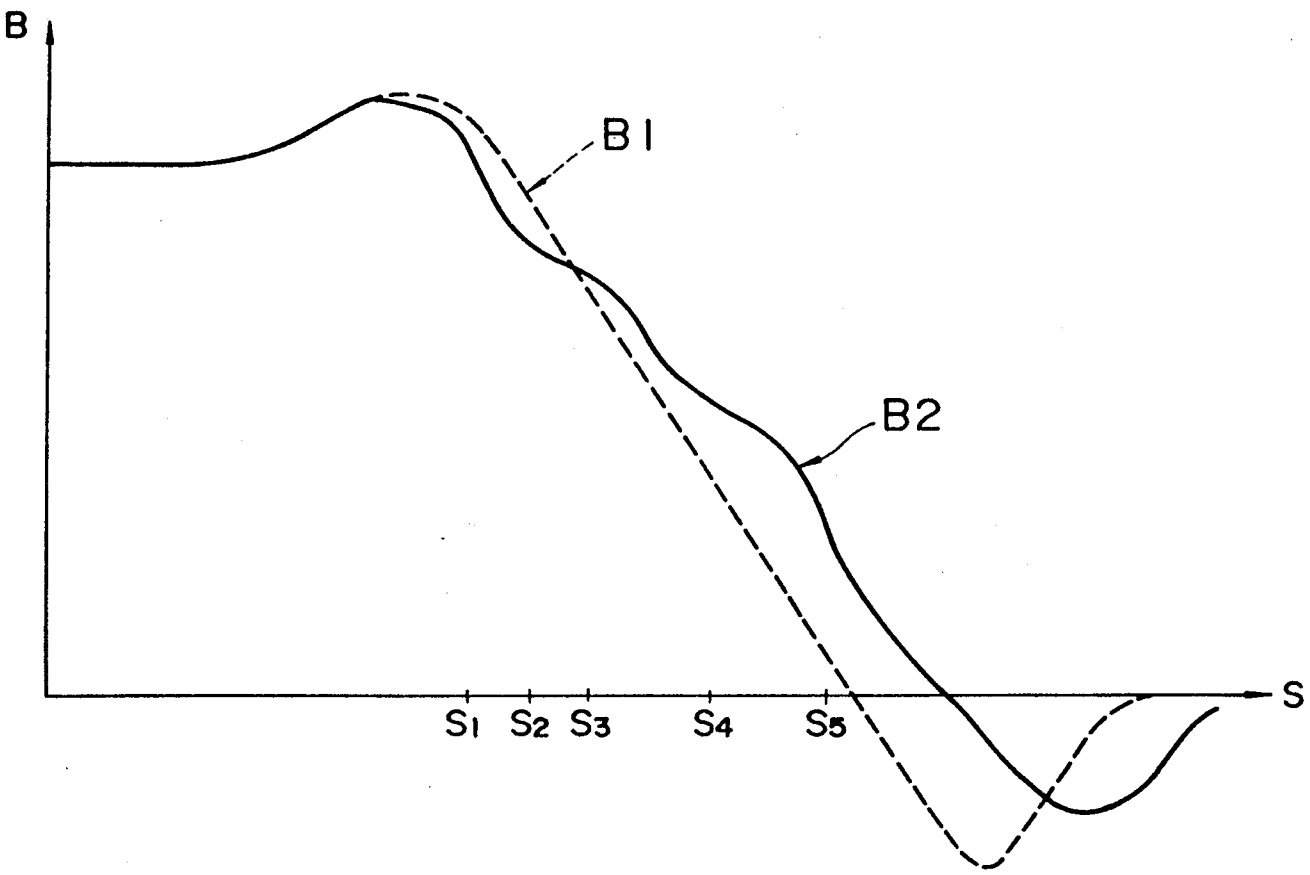
FIG. 11 PRIOR ART
FIG. 11 shows the variations of the magnetic field along the electron orbit near the end portions of the main coils.

The variation of the magnetic field B along the orbit S near the end portions of the coils 2 and 3 of this embodiment is rendered substantially even, compared with the case of the magnet shown in FIGS. 7 and 8. The reason therefor is as follows: Let the average current density within the coils 2 and 3 be represented by j; then, the magnetomotive force ΔAT which is generated by one of the parts 21, 22, 31, and 32 of the coils 2 and 3 within a length ΔS along the direction of the orbit S is expressed as follows:

$$\Delta AT = j.y.\Delta S,$$

where y is the thickness of the coil parts (y=y1=y2). Thus, the magnetomotive force AT per unit length along the orbit S, generated by the upper or lower main coil 2 or 3, is equal to:

$$AT = \Delta AT/\Delta S = j.y,$$

which is constant over the whole length W of the end portions of the coils 2 and 3 along the orbit S. Thus, in contrast to the case of FIG. 8 where the magnetomotive force is not present at positions along the orbit S corresponding to spacers 4 and hence the variation of the magnetic field is uneven, the magnetic field generated at the end portions of the coils 2 and 3 of this embodiment varies evenly and smoothly.

The suppression of the maximum magnetic field Bmax acting on the coils is also improved by the coil design of this first embodiment; this may be explained as follows. It should be noted that the magnetomotive force is distributed evenly and uniformly over the length W along the orbit S. Generally, the width W of the end portions of the coils 2 and is predetermined by the conditions which are imposed on the design of the coils by other structural components of the magnet. For example, the width W is limited by the practical size of the cryostat (not shown) accommodating the superconducting coil assembly therein for maintaining it at an extreme low temperature. Further, the principal purpose of utilizing superconducting coils as the deflection magnets is to reduce the size of high performance deflection magnets having a high deflection capability. Thus, a larger dimension of W diminishes the advantages of the superconducting coils. It can be easily comprehended that if, within the given upper limit of width W as pointed out above, the regions where the magnetomotive force is present and the regions where the magnetomotive force is absent alternate each other along the orbit S as in the conventional case, the suppressive effect on the maximum magnetic field Bmax acting on the coils is reduced since the magnetomotive force is concentrated to small regions along the orbit S. In contrast thereto, since the magnetomotive force is distributed evenly over the width W along the orbit S according to this embodiment, the maximum magnetic field Bmax acting on the coils 2 and 3 can be suppressed effectively compared with the conventional case.

Figure 15:
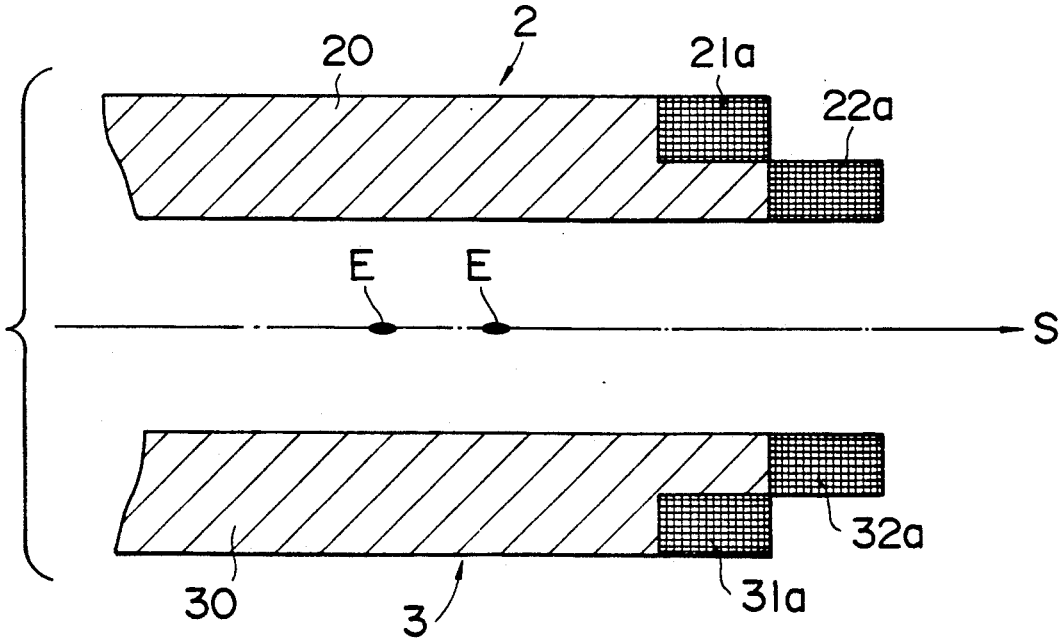
FIG. 15 is a sectional view similar to that of FIG. 13, but showing a modified coil structure.

According to the first embodiment described above, the upper and lower main coils 2 and 3 are each divided into two separate coil parts. As shown in FIG. 15, however, the upper and lower coils 2 and 3 may each consist of an integrally wound coil, the coil frames 20 and 30, shown in cross section in FIG. 15, being provided with steps at the ends thereof, such that the end portions, 21*a* and 22*a*, and 31*a* and 32*a*, of the coils 2 and 3 are displaced from each other in the direction of the orbit S.

Figure 16:
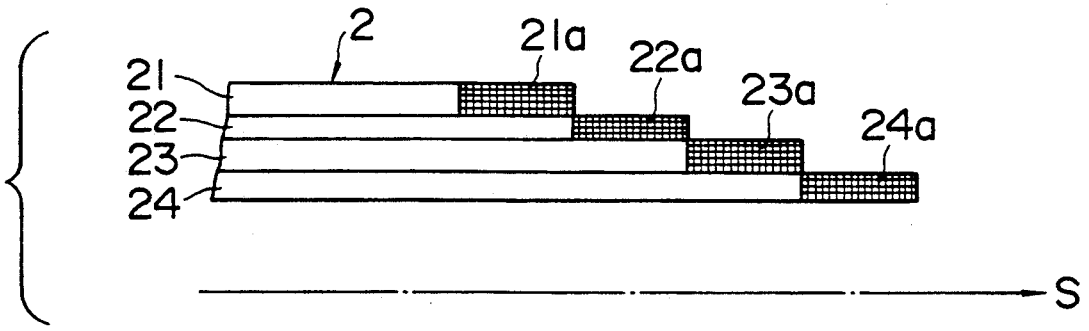
FIGS. 16 through 20 are upper half sectional views along the electron orbit, respectively, of various modifications of the first embodiment.

Further, FIG. 16 shows a modification of the first embodiment. As shown in FIG. 16, the upper main coil 2 is divided into four coil parts 21, 22, 23, and 24, the end portions thereof 21*a* and 22*a*, 23*a*, and 24*a* being successively displaced in the direction of the orbit S; the lower main coil 3 (not shown) has a structure identical to that of the upper main coil 2, being disposed symmetrically with respect to the plane of the orbit S. It goes without saying that the number of division of the coils 2 and 3 may be more than four. The suppressive effect on the maximum magnetic field acting on the coils, or the evenness of the variation of the magnetic field along the orbit S, is as enhanced as, or even more enhanced than, the case of the first embodiment described above.

Figure 17:
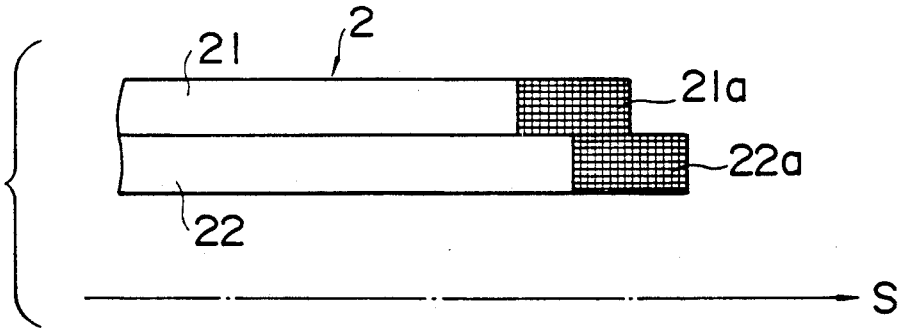

Further, according to the first embodiment, the end portions of the coil parts do not overlap in the direction of the orbit S; However, as shown in FIG. 17 which depicts the upper coil 2 only, the end portions 21*a* and 22*a* of the coil parts 21 and 22 may be overlapped in the direction of the orbit S, the lower coil 3 (not shown) being symmetrical to the upper coil 2 with respect to the plane of the orbit S. Substantially the same advantages are obtained according to this design as in the case of the first embodiment. This overlapping coil end design has the additional advantage that the electromagnetic force acting between the coil parts 21 and 22 can be supported with enhanced reliability by the overlap of the end portions 21*a* and 22*a*.

Figure 18:
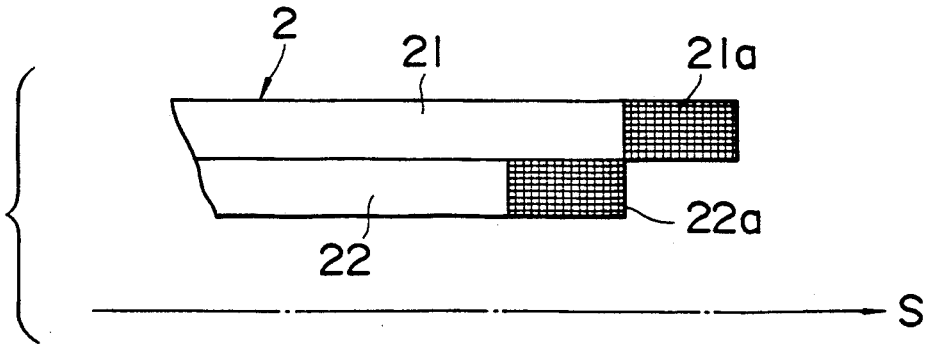

Furthermore, according to the first embodiment, the end portions 21*a* and 31*a* of the coil parts 21 and 31 positioned vertically farther away from the orbit S are positioned to the more inner side of the coils 2 and 3 in the direction of the orbit S than the end portions 22*a* and 32*a* of the coil parts 22 and 32 positioned vertically nearer to the orbit S. The relative positions along the orbit S of the end portion 21*a* or 31*a* and the end portion 22*a* or 32*a* may be reversed as shown in FIG. 18, which show the upper coil 2 only.

Figure 19:
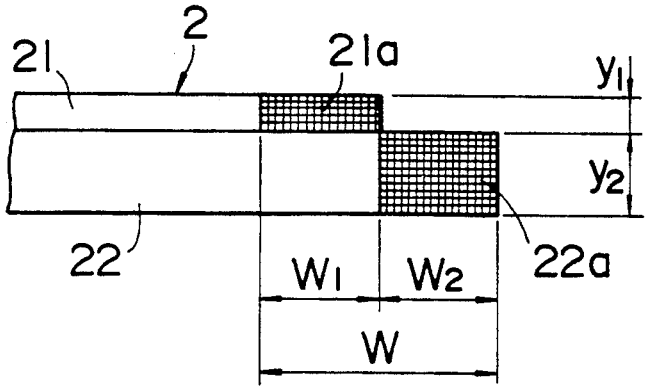
Figure 20:
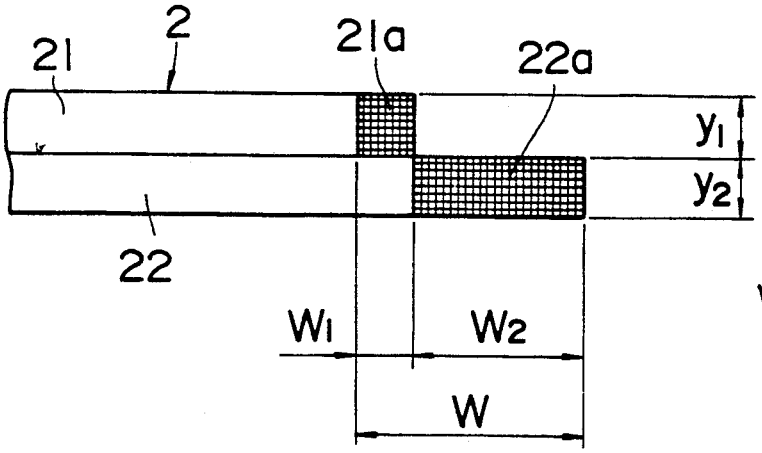

Still further, as shown in FIGS. 19 and 20, the widths W1 and W2 and the thickness y1 and y2 of the coil parts 21 and 22 (or the coil parts 31 and 32 symmetric thereto) can be modified and selected at respective different values at the combination of which values the suppressive effect on the maximum field acting on the coils 2 and 3 may be maximized.

Figure 1:
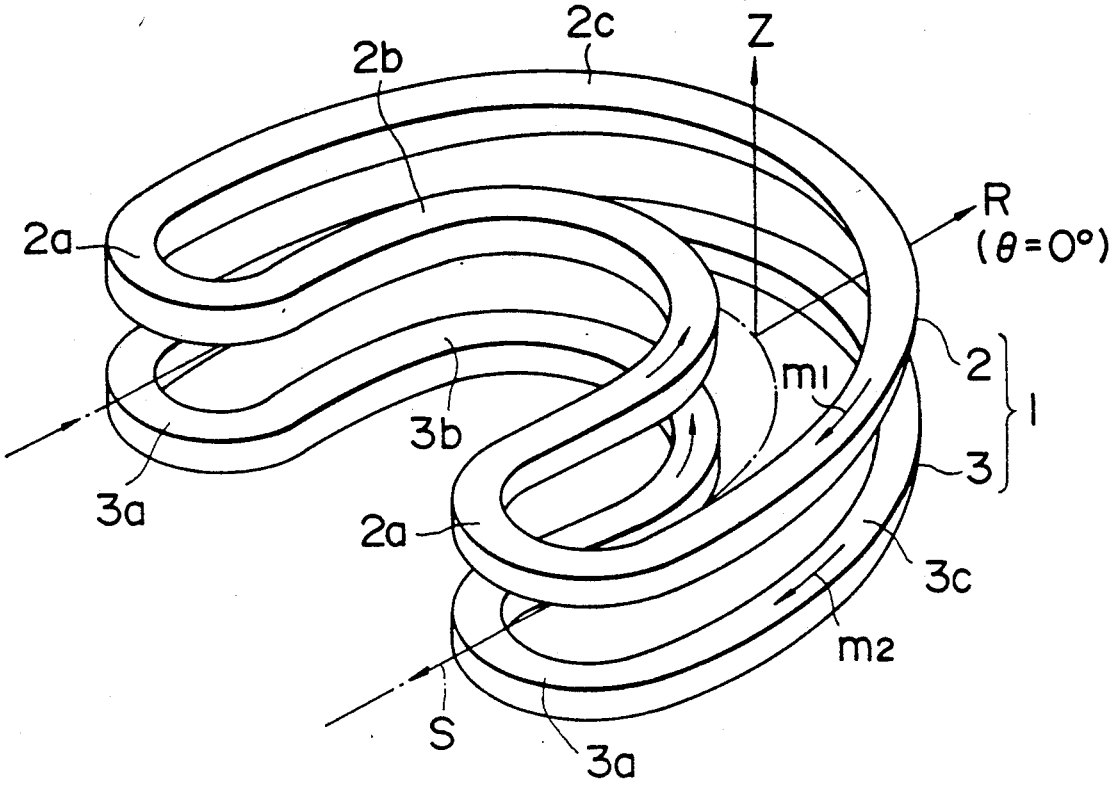
FIG. 1 PRIOR ART
FIG. 1 is a perspective view of the main coils of a superconducting deflection magnet, showing the overall configuration thereof.
Figure 2:
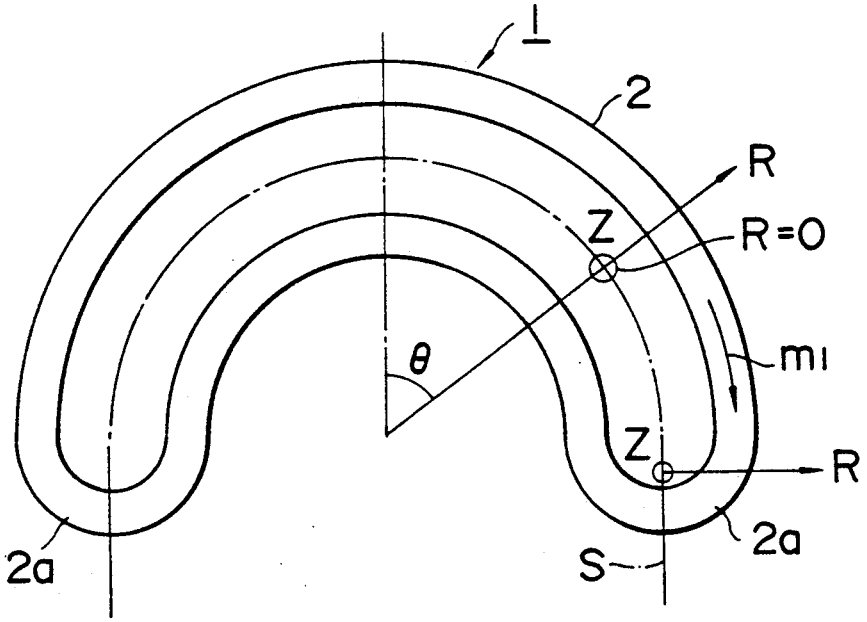
FIG. 2 PRIOR ART
FIG. 2 is a plan view of the magnet of FIG. 1.
Figure 3:
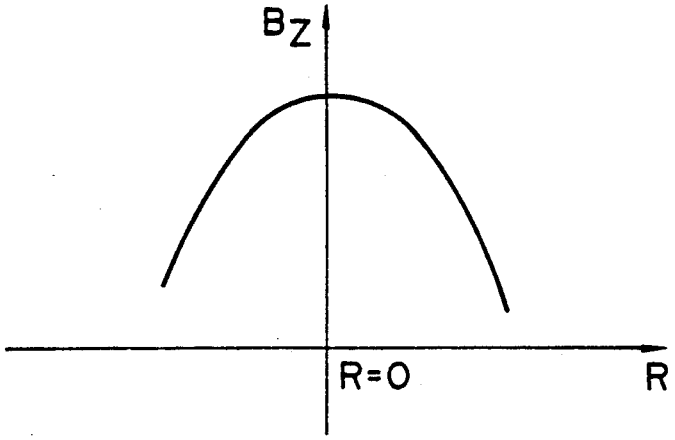
FIG. 3 PRIOR ART
FIG. 3 is a graph showing the variation or distribution of the magnetic field along the radial direction, generated near the end portions of the coils of FIG. 1.
Figure 4:
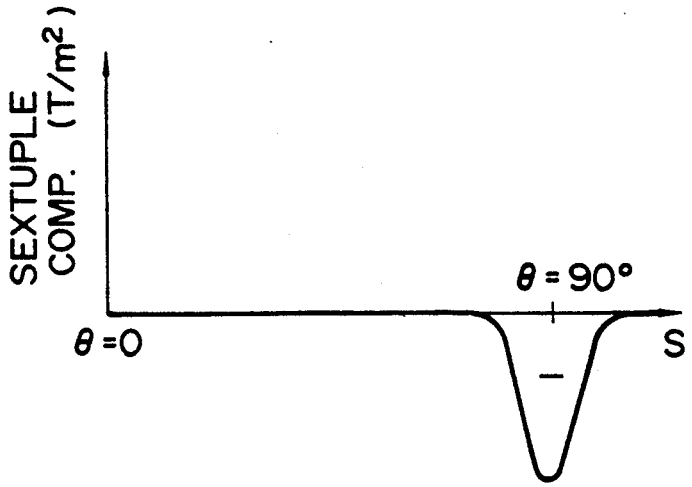
FIG. 4 PRIOR ART
FIG. 4 is a graph showing the sextupole field component generated by the deflection magnet of FIG. 1 along the orbit S.
Figure 5:
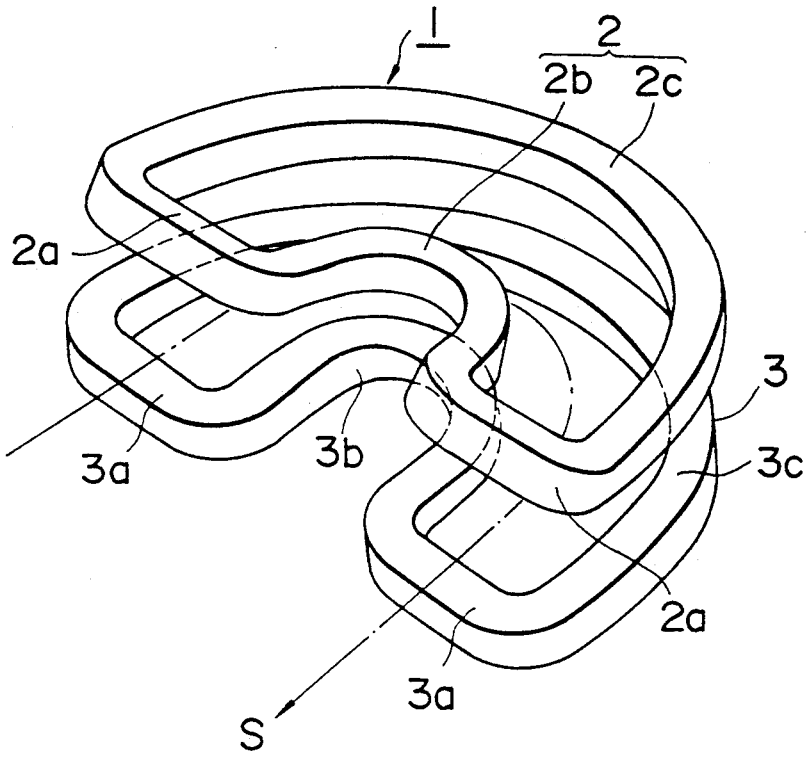
FIG. 5 PRIOR ART
FIG. 5 is a perspective view of a conventional superconducting deflection magnet whose end portions are bent away from the electron beam orbit.
Figure 6:
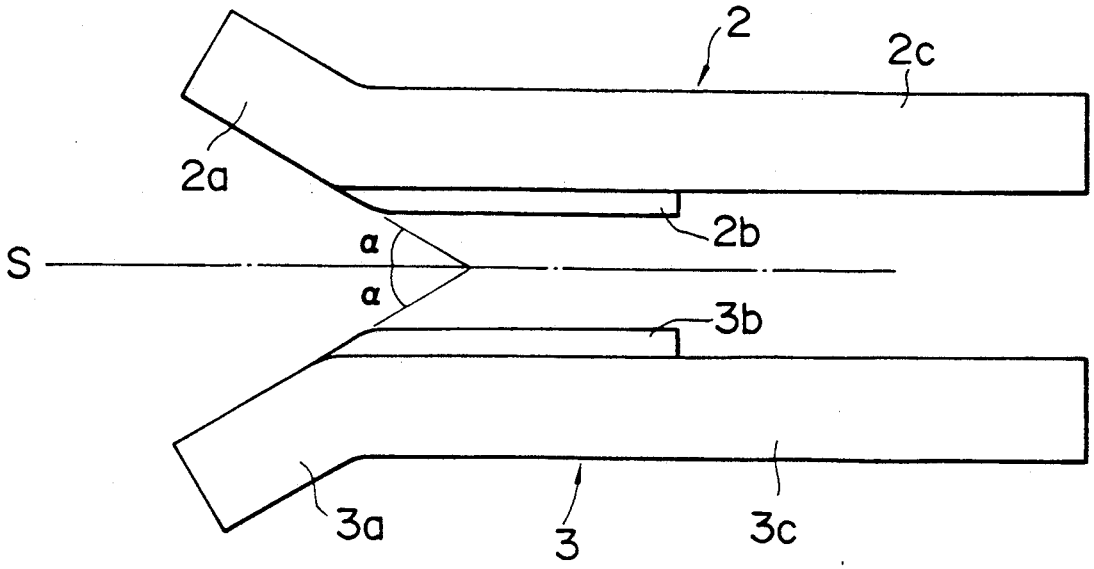
FIG. 6 PRIOR ART
FIG. 6 is a side view of the magnet of FIG. 5.
Figure 21:
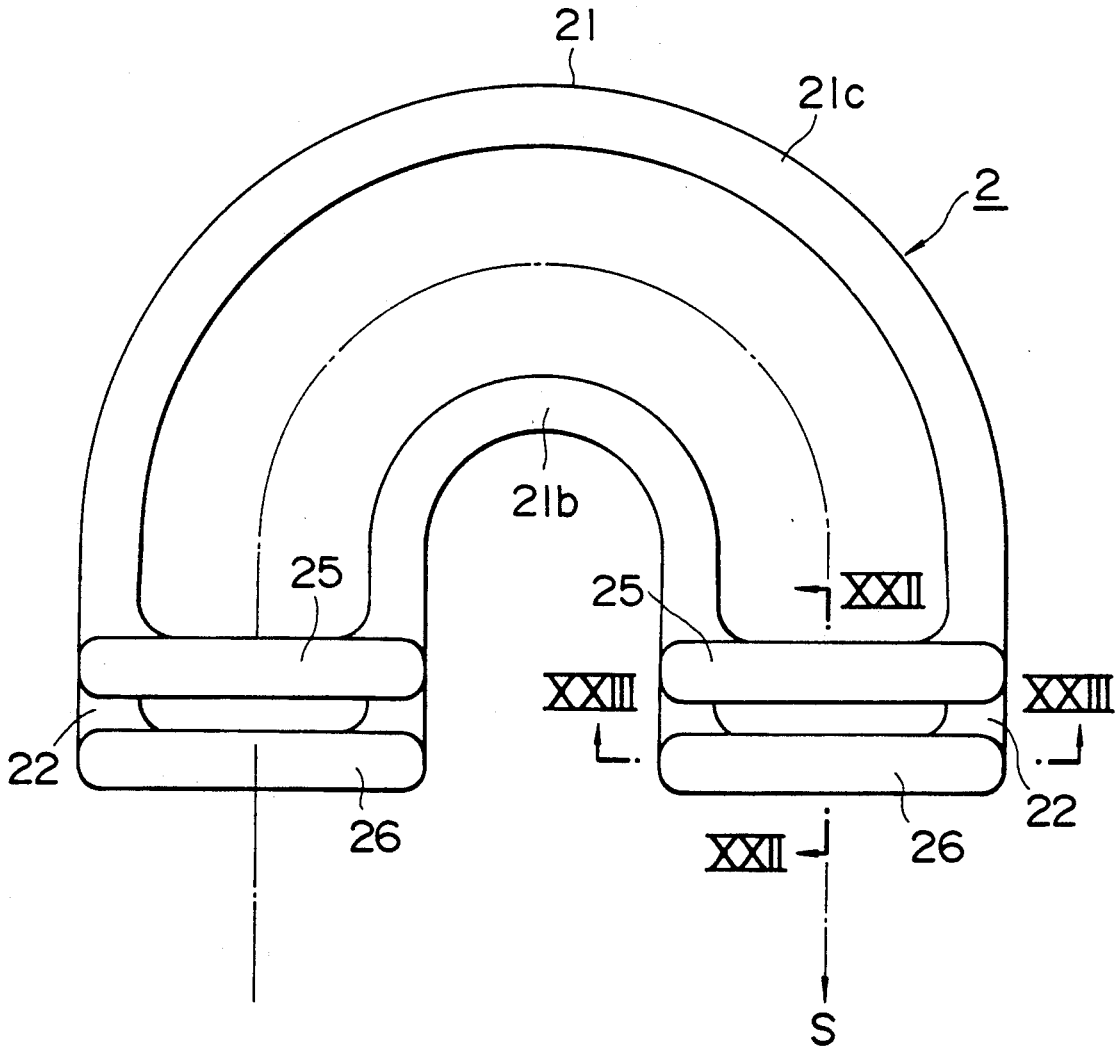
Figure 22:
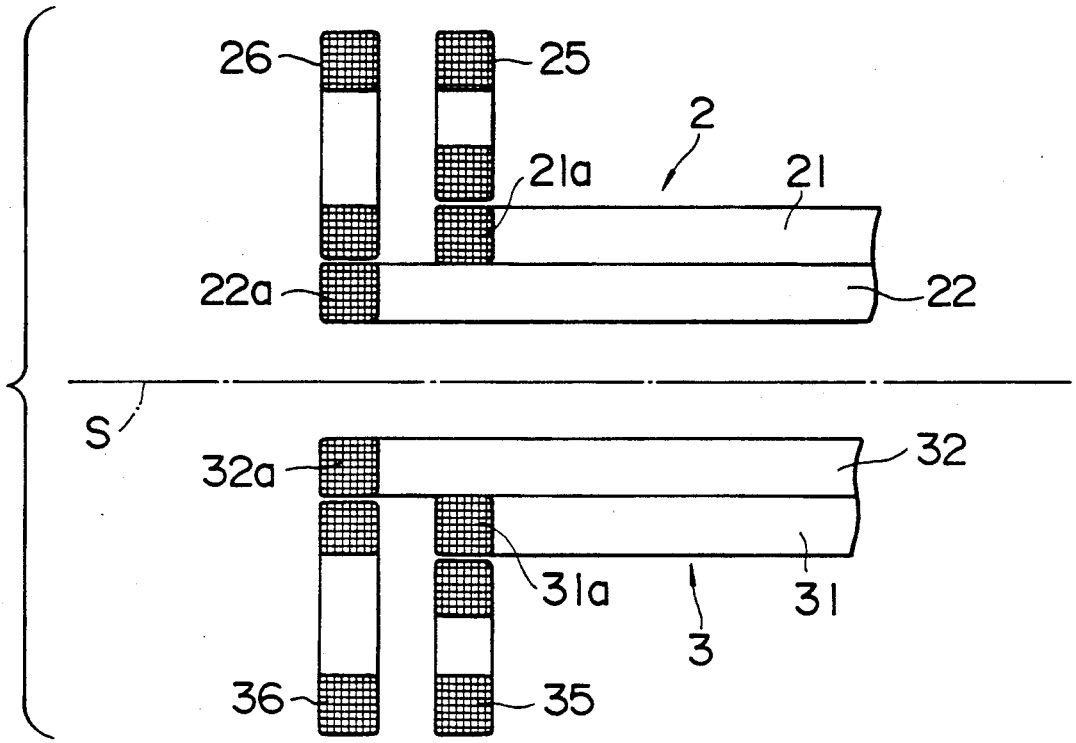
Figure 23:
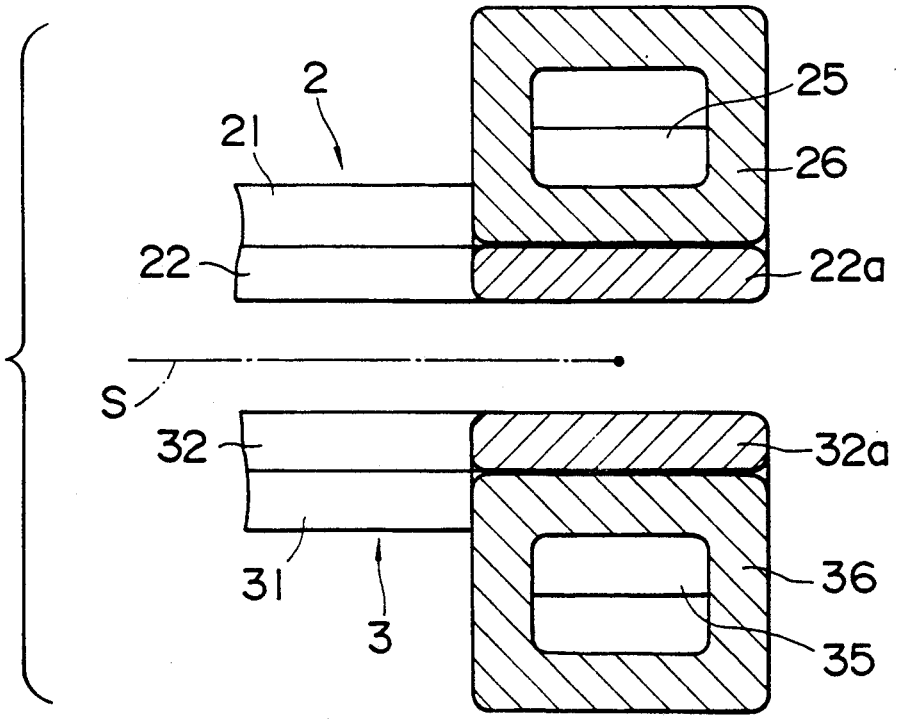

Referring next to FIGS. 21 through 23, let us describe a coil structure of a deflection magnet which has a meritorious effect similar to that obtained by the magnet shown in FIGS. 5 and 6.

As shown in FIGS. 21 through 23, the upper and lower main coils 2 and 3 are each divided into two coil parts, 21 and 22, and 31 and 32, respectively, the end portions, 21*a* and 22*a*, and 31*a* and 32*a*, thereof being displaced from each other in the direction of the orbit S. In addition, rectangular cancellation coils 25 and 26 are disposed on top of the end portions 21*a* and 22*a*, respectively, of the coil parts 21 and 22 of the upper coil 2, such that the bottom sides (i.e., the portions situated nearest to the orbit S) of the cancellation coils 25 and 26 run parallel and adjacent to the end portions 21*a* and 22*a* bridging the inner and outer branches 21*b* and 21*c* of the coil parts 21 and 22 (see FIG. 21). Similarly, rectangular cancellation coils 35 and 36 are disposed on the vertically outward directed side of the end portions 31*a* and 32*a*, respectively, of the coil parts 31 and 32 of the lower coil 3, such that the vertically inward sides of the cancellation coils 35 and 36 run parallel and adjacent to the end portions 31*a* and 32*a* bridging the inner and outer branches of the coil parts 31 and 32.

Figure 24:
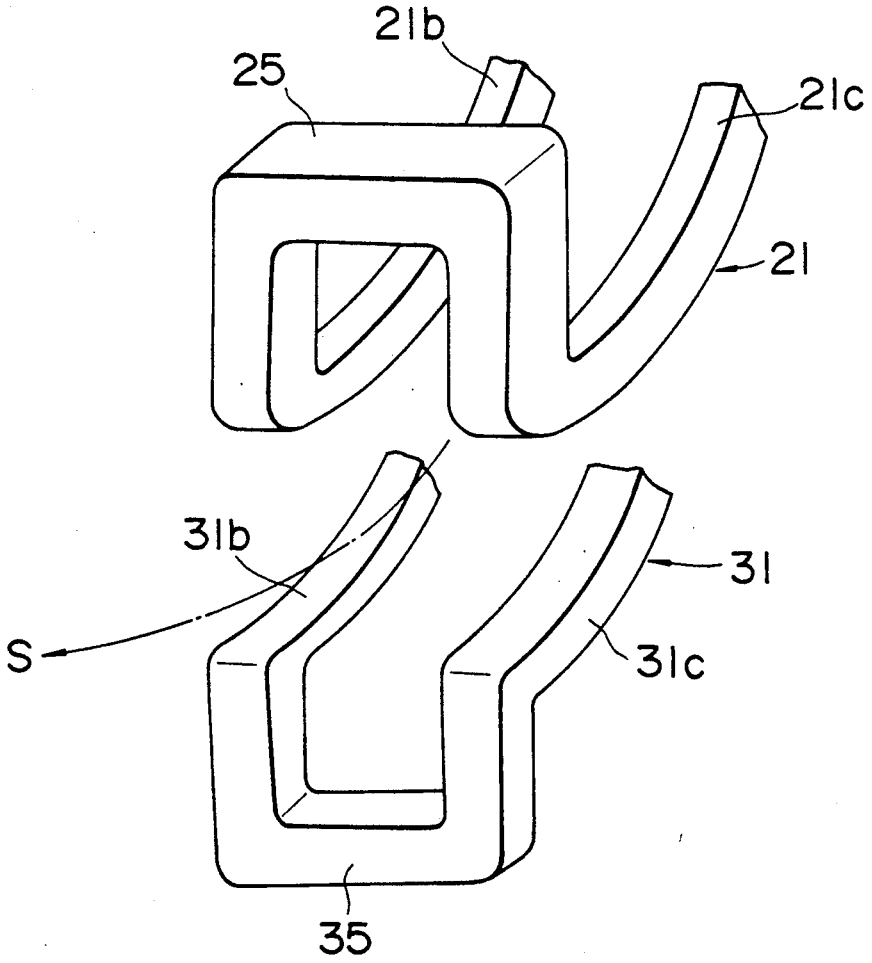
FIG. 24 show an equivalent coil configuration of a part of the coil assembly of FIGS. 21 through 23.

In operation, the direction and the magnitude of the current flowing through the cancellation coils 25, 26 is selected such that the magnetomotive force generated by the bottom (i.e., vertically inward) sides of the cancellation coils 25 and 26 and the magnetomotive force generated by the adjacent end portions 21*a* and 22*a* running parallel thereto are equal in magnitude but opposite in direction. Thus, the magnetomotive forces generated by the end portions 21*a* and 22*a*, respectively, are completely cancelled by the magnetomotive force generated by the bottom side portions of the cancellation coils 25 and 26, respectively. Similarly, the direction and the magnitude of the current flowing through the cancellation coils 35, 36 are selected such that the magnetomotive force generated by the vertically inward sides of the cancellation coils 35 and 36 and the magnetomotive force generated by the adjacent end portions 31*a* and 32*a* running parallel thereto are equal in magnitude but opposite in direction. Thus, the magnetomotive force generated by the end portions 31*a* and 32*a*, respectively, are completely cancelled by the magnetomotive force generated by the vertically inward sides of the cancellation coils 35 and 36, respectively. Thus, the equivalent coil configuration of the coil parts 21 (including the inner and outer branches 21*b* and 21*c* thereof) and the cancellation coil 25 (bridging the inner and outer branches 21*b* and 21*c* of the coil part 21) and that of the coil part 31 (including the inner and outer branches 31*b* and 31*c* thereof) and the cancellation coil 25 (bridging the inner and outer branches 31*b* and 31*c* of the coil part 31) may be represented as shown in FIG. 24. The equivalent coil configuration of the coil parts 22 and the cancellation coil 26 and of the coil part 32 and the cancellation coil 36 is similar to that shown in FIG. 24.

Thus, as is evident from FIG. 24, the coil assembly of FIGS. 21 through 23 is equivalent to the coil configuration wherein the end portions bridging the inner and outer branches of the main coils are bent at right angles thereto such that the bridging portions of the coils (represented at 25 and 35 in FIG. 24) extending in the radial direction perpendicular to the direction of the orbit S are situated sufficiently vertically far away from the orbit S. Hence, the effect on the orbit S of the magnetic field generated by these bridging portions of the coils is negligible. It is noted that an enhanced uniformity of the field can be obtained according to this coil assembly, although the coil assembly consists solely of flat coils having not bent portions.

According to the embodiment shown in FIGS. 21 to 23, the planes of the cancellation coils 25, 26, 35, and 36 are substantially perpendicular to the plane of the orbit S; however, they may be disposed at about 30 degrees to the plane of the orbit S. Then, the meritorious effects of the coil assembly are substantially equivalent to those of the magnet shown in FIGS. 5 and 6. It is further noted that, as in the case of the first embodiment described above, the division of the upper and lower main coils 2 and 3 into coil parts, 21 and 22, and 31 and 32, having end portions displaced from each other in the direction of the orbit S has the suppressive effect on the maximum field acting on the coils 2 and 3.

Figure 25:
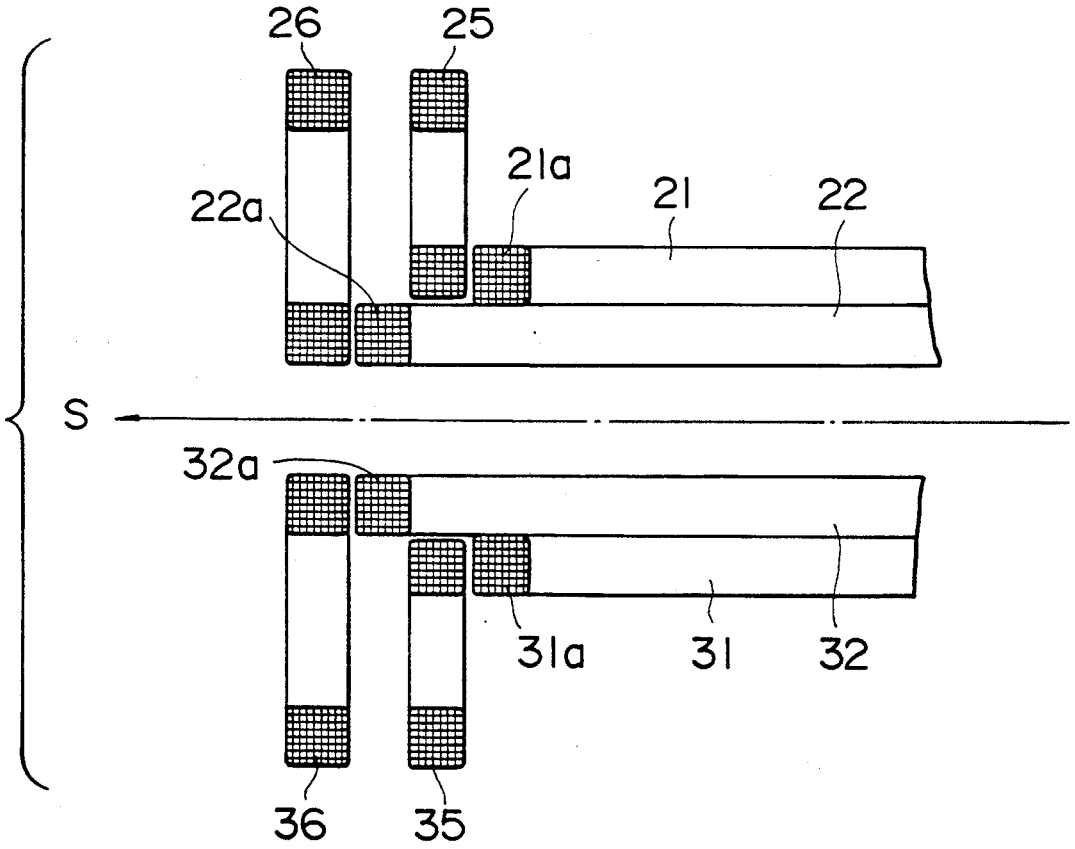
FIG. 25 is a sectional view similar to that of FIG. 22, but showing a modified coil structure thereof.

According to the embodiment shown in FIGS. 21 through 23, the cancellation coils are positioned on top of the end portions of the coil parts, i.e., on the side of the end portions directed away from the orbit S. However, as shown in FIG. 25, the cancellation coils 25, 26, 35, and 36 may be disposed at the horizontally outer side of the end portions 21*a*, 22*a*, 31*a*, and 32*a*, respectively, of the coil parts 21, 22, 31, and 32.

Figure 26:
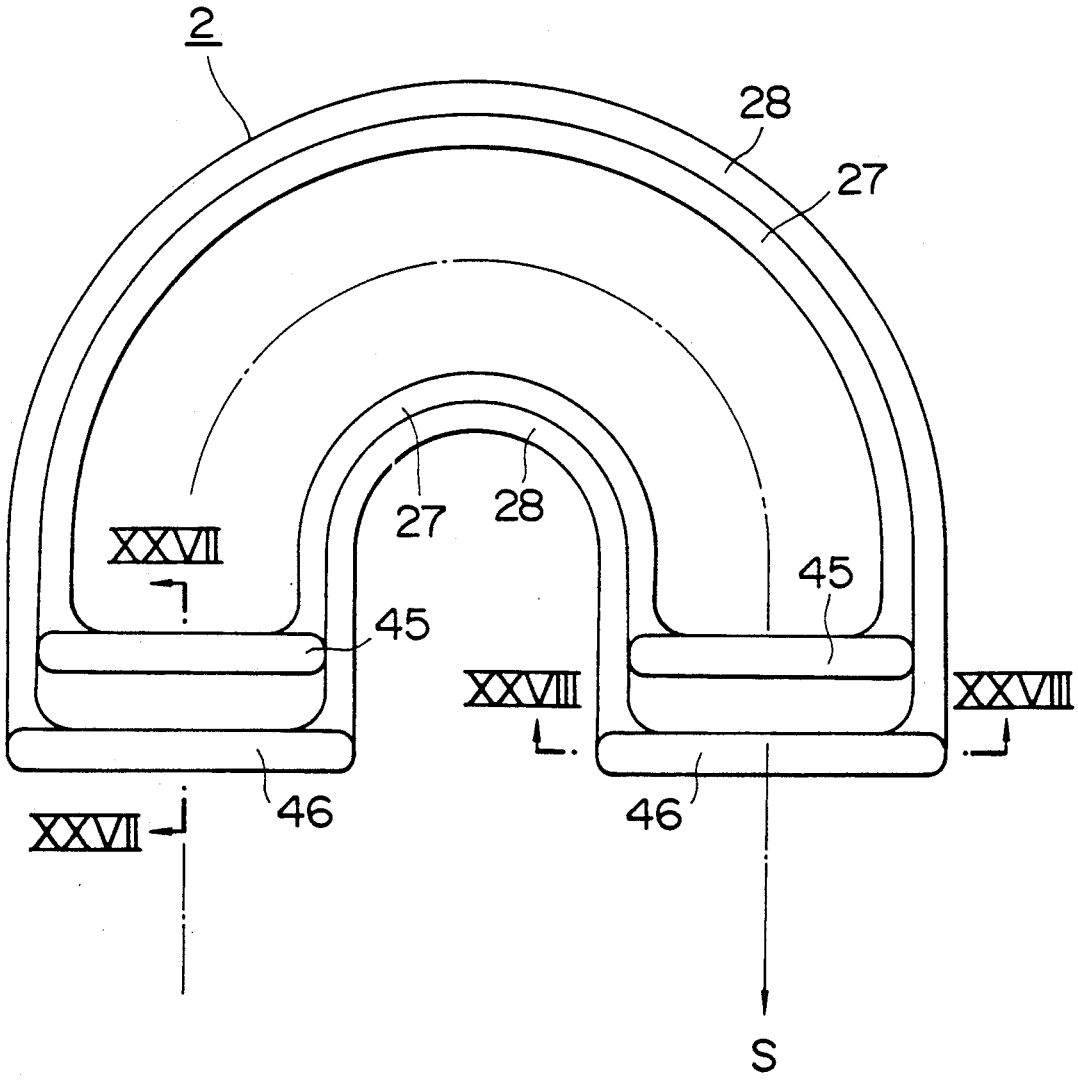
Figure 27:
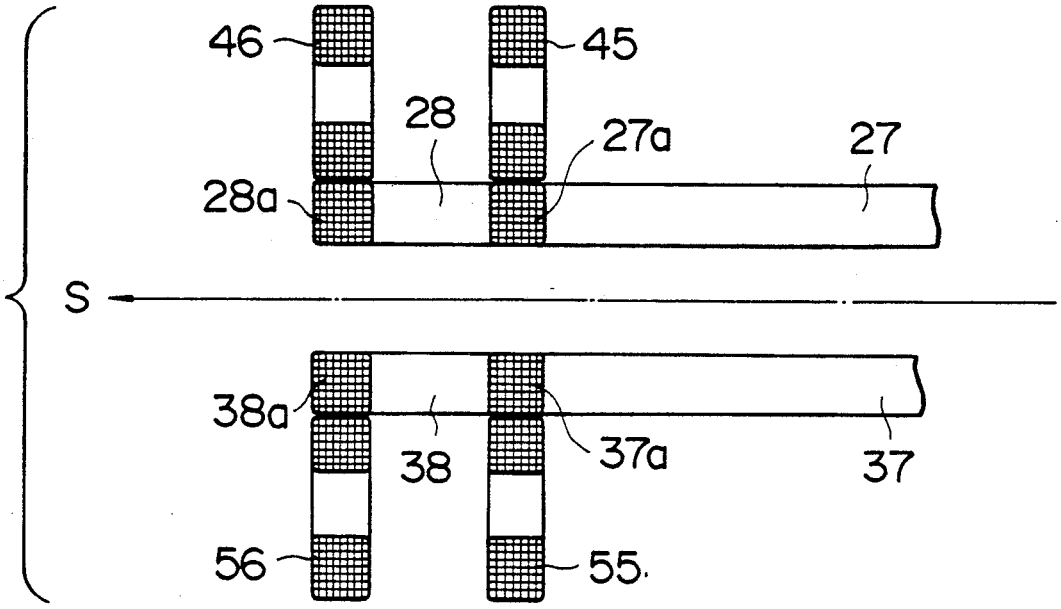
Figure 28:
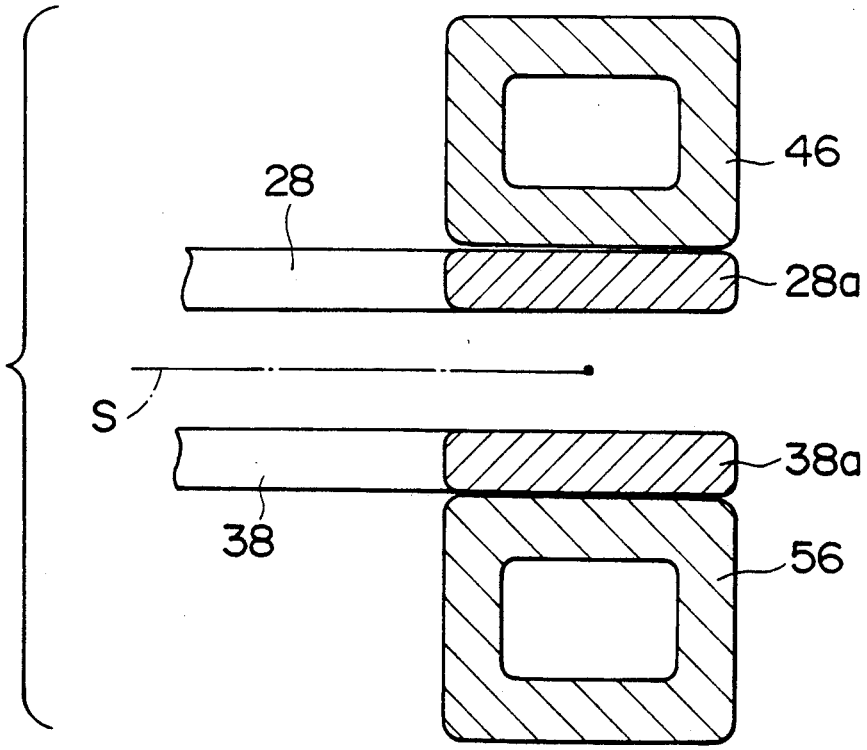

Further, according to the embodiment of FIGS. 21 through 23, the upper and lower main coils 2 and 3 are divided into two coil parts through a plane parallel to the plane of the orbit S. As shown in FIGS. 26 through 28, however, the upper and lower coils 2 and 3 may each be divided into two coil parts through a curved surface perpendicular to the plane of the orbit S. In FIGS. 26 through 28, the upper coil 2 is divided into inner and outer coil parts 27 and 28; the lower coil 3 is divided into inner and outer coil parts 37 and 38. The cancellation coils 45 and 46 are disposed on top of the end portions 27*a* and 28*a* of the coil parts 27 and 28, respectively; similarly, the cancellation coils 55 and 56 are disposed on the surfaces of the end portions 37*a* and 38*a* of the coil parts 37 and 38 which are directed away from the orbit S.

Substantially the same meritorious effects can be obtained by the embodiment of FIGS. 26 through 28 as by that of FIGS. 21 through 23, with respect to the uniformity of the magnetic field near the orbit S as well as with respect to the suppression of the maximum field acting on the coils. Further, it is noted with regard to the embodiments shown in FIGS. 21 through 28 that the absolute values of the magnetomotive forces of the end portions of the main coils and of the portions of the cancellation coils running parallel and adjacent thereto need not necessarily be equal, as is the case in the above embodiments, provided that the ratio of the magnetomotive forces is such that the non-uniformity of the magnetic field near the electron orbit is minimized, or such that only specific non-uniform magnetic field components are generated by the coil assembly near the electron orbit.

Figure 29:
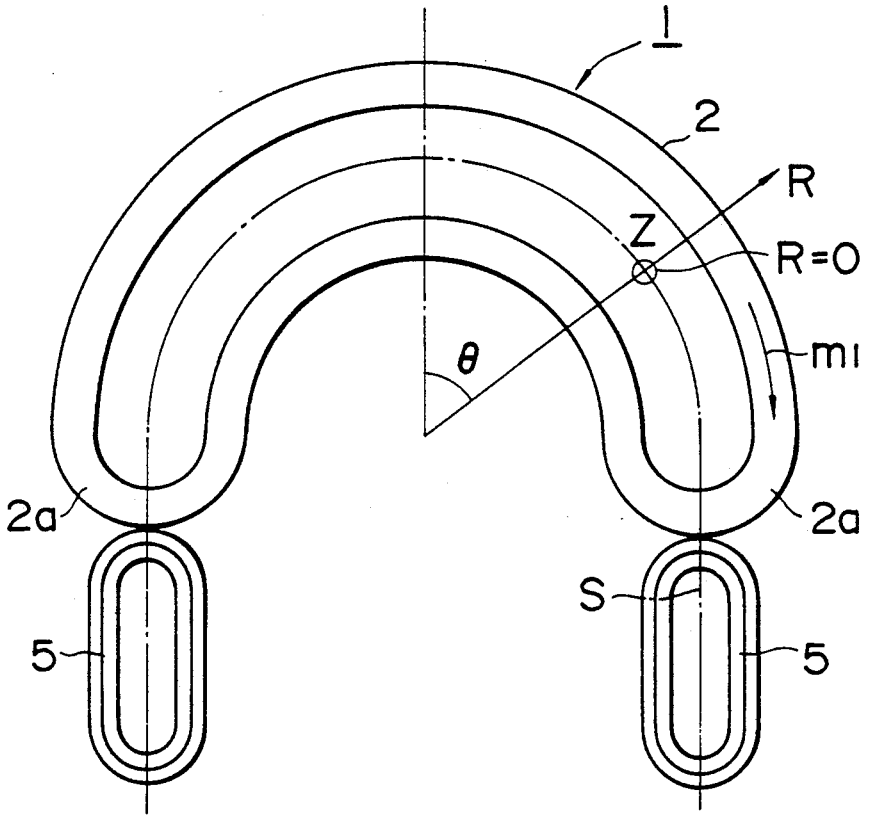
FIG. 29 is a plan view of a further magnet according to this invention which comprises sextupole correction coils.

Referring next to FIG. 29 of the drawings, let us describe a further embodiment provided with sextupole correction coils.

Figure 30:
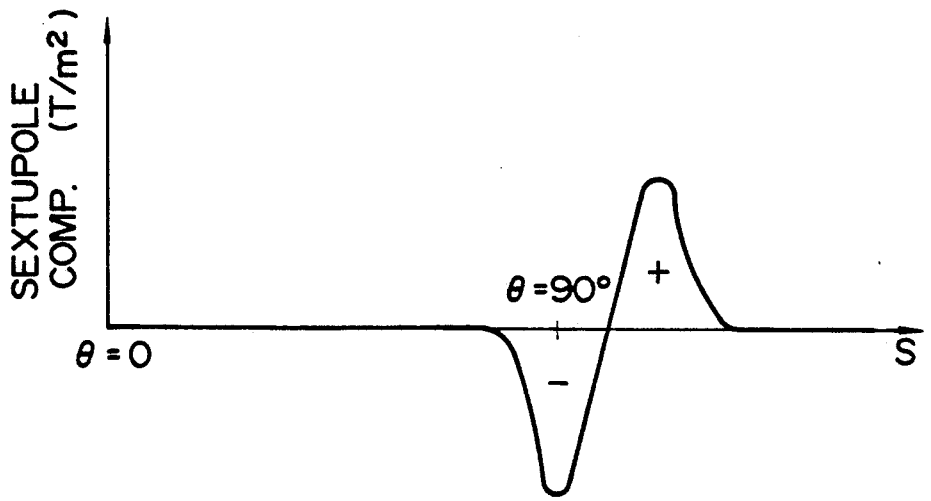
FIG. 30 shows the distribution of the sextupole component along the electron orbit, generated by the coil assembly of FIG. 29.

As discussed above in the introductory portion of this specification by reference to FIGS. 1 through 4, the magnetic field generated by the main coils 2 and 3 near the end portions 2*a* and 3*a* thereof comprises error field consisting primarily of sextupole components. Thus, as shown in FIG. 29, a sextupole correction coil 5 is provided at the outer side of each one of the end portions 2*a* (and 3*a*) of the main coils 2 (and 3). (With regard to the overall structure of the main coils 2 and 3, reference should also be made to FIGS. 1 and 2.) Each one of the sextupole correction coils 5 consists, for example, of upper and lower race-track shaped coils running parallel to each other, and produces a positive sextupole magnetic field (a field $B_z$ which varies in the radial direction R in accordance with a quadratic curve convex toward below) near the orbit S. Thus, the sextupole field component generated by the coil assembly of FIG. 29 varies along the orbit S as shown in FIG. 30. As shown further in FIG. 30, the region of the positive sextupole component along the orbit S generated by a correction coil 5 is adjacent to the region of the negative sextupole component generated by the main coils near the end portions thereof; the magnitude of the current through the sextupole correction coils 5 is adjusted such that the integral of the sextupole component along the length of the orbit S vanishes. Thus, as is known from the results of beam tracking, the effect of the negative sextupole component on the electron beam is cancelled by that of the adjacent positive sextupole component, so that the electron beam is deflected properly along the orbit S. It is noted in this connection that, as is also known from the results of beam tracking, this compensating effect of the positive sextupole component with respect to the negative sextupole component is lost when the region of the positive component is separated from that of the negative component by a distance along the orbit S greater than a certain value.

Figure 31:
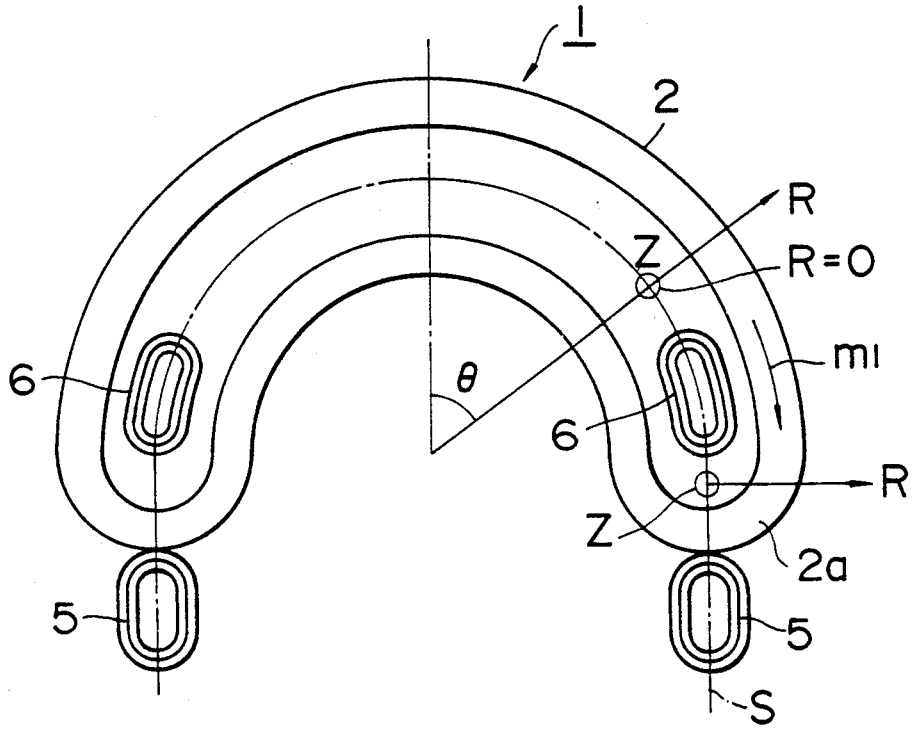
FIGS. 31 and 32 are views similar to those of FIGS. 29 and 30, respectively, but showing a modification thereof.
Figure 32:
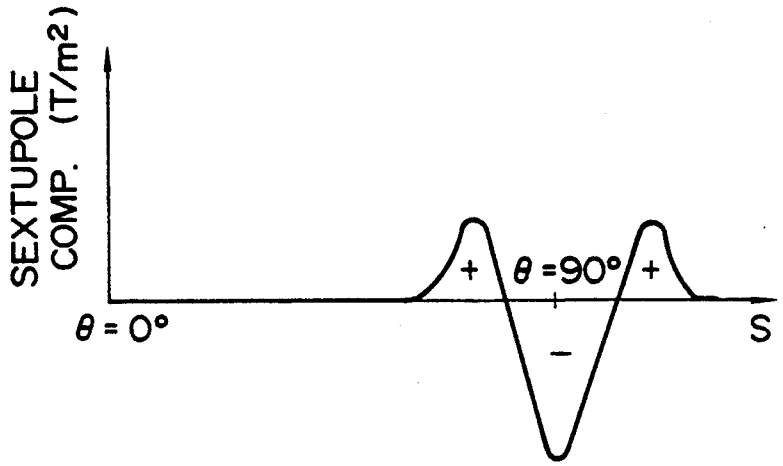

Thus, in the case where the region of the negative sextupole field components generated by the main coils near the end portions thereof extend over a great length along the orbit S, it is preferred, as shown in FIG. 31, that a pair of sextupole correction coils 5 and 6 are disposed at both the inner and outer sides, along the orbit S, of each one of the end portions 2*a* and 3*a* of the main coils 2 and 3. Each one of the sextupole correction coils 5 and 6 of FIG. 31 has a structure similar to that of the sextupole correction coils 5 of FIG. 29, and produces a negative sextupole field near the orbit S. FIG. 32 shows the distribution of the sextupole component generated by the coil assembly of FIG. 31 along the orbit S. The magnitudes of the currents through the sextupole correction coils 5 and 6 are selected such that the integral of the sextupole components along the orbit S vanishes.

It is noted that correction coils similar to those shown in FIGS. 29 and 31 may also be utilized for cancelling and compensating for the effects of multipolar magnetic field components—quadrapole, octapole, and, generally, 2n-pole components—other than the sextupole component. Further, the main coils 2 and 3 may have bent end portions as shown in FIGS. 5 and 6, or be divided into two or more coil parts.

What is claimed is:

1. A deflection magnet for deflecting a charged particle beam along a semicircular orbit, said deflection magnet comprising:

an upper and a lower race-track shaped superconducting coil bent into a semicircular form along the semicircular orbit divided into at least two coil parts through a plane perpendicular to the plane of the orbit of the charged particle beam and disposed symmetrically with respect to the plane of the orbit of the charged particle beam, said race-track shaped upper and lower coils each including radially inner and outer semicircular branches running parallel to the semicircular orbit and end portions bridging the radially inner and outer branches; wherein each one of the end portions of the upper and lower coils is divided into at least two parts which are displaced from each other in a plane parallel to the plane of the orbit.

2. A deflection magnet for deflecting a charged particle beam along a semicircular orbit, said deflection magnet comprising:

race-track shaped main coils bent into a semicircular form along the semicircular orbit, and disposed symmetrically with respect to the plane of the orbit of the charged particle beam, said race-track shaped main coils including end portions bridging radially inner and outer semicircular branches thereof running parallel to the semicircular orbit; and rectangular cancellation coils each provided at one of said end portions of the main coils, each cancellation coil having a side running parallel and adjacent to one of the end portions of the main coils, the plane of each one of the cancellation coils forming a substantial angle to the plane of the orbit, wherein the direction and magnitude of current flowing in each one of the cancellation coils is such that the magnetomotive force of the current flowing through the side of each cancellation coil parallel and adjacent to an end portion of the main coils is equal in magnitude and opposite in direction to the magnetomotive force of a current flowing through the end portion.

3. A deflection magnet as claimed in claim 2, wherein the plane of each one of the cancellation coils form a right angle to the plane of the orbit.

4. A deflection magnet as claimed in claim 1, wherein each one of said main coils is divided at least into two coil parts, the end portion of each one of the coil parts being provided with a cancellation coil having a side running parallel and adjacent to the end portion.

5. A deflection magnet for deflecting a charged particle beam along a semicircular orbit, said deflection magnet comprising:

race-track shaped main coils bent into a semicircular form along the semicircular orbit and disposed symmetrically with respect to the plane of the orbit of the charged particle beam, said race-track shaped main coils including end portions bridging radially inner and outer semicircular branches thereof running parallel to the semicircular orbit; and multipolar correction coils each disposed near one of the end portions of the main coils along the orbit of the charged particle, such that an integral of a multipolar magnetic field component, generated by the main coils and the correction coils, along the orbit of the charged particle beam vanishes.

6. A deflection magnet as claimed in claim 5, wherein said multipolar correction coils comprise sextupole correction coils.

7. A deflection magnet as claimed in claim 5 wherein the main coils are divided through a plane parallel to the plane of the orbit of the charged particle beam.

8. A deflection magnet as claimed in claim 2 wherein the main coils are divided into at least two parts through a plane perpendicular to the plane of orbit of the charged particle beam.

9. A deflection magnet as claimed in claim 2 wherein the main coils are divided into at least two parts through a plane parallel to the plane of orbit of the charged particle beam.

10. A deflection magnet for deflecting a charged particle beam along a semicircular orbit, said deflection magnet comprising:

upper and lower race-track shaped superconducting coils bent into semicircular form along the semicircular orbit and disposed symmetrically with respect to the plane of the orbit of the charged particle beam, said race-track shaped upper and lower coils each including radially inner and outer semicircular branches running parallel to the semicircular orbit and end portions bridging the radially inner and outer branches; wherein each one of the end portions of the upper and lower coils is divided into at least two layers disposed in a stepped configuration.

* * * * *

UNITED STATES PATENT AND TRADEMARK OFFICE

CERTIFICATE OF CORRECTION

PATENT NO. : 5,111,173

DATED : May 5, 1992

INVENTOR(S) : Matsuda et al.

It is certified that error appears in the above-identified patent and that said Letters Patent is hereby corrected as shown below:

ON THE TITLE PAGE

Item No. [57], Abstract, line 2, change "semiconductor" to --semicircular--.

Signed and Sealed this

Twentieth Day of July, 1993

*Attest:*

Michael K. Kirk

MICHAEL K. KIRK

*Attesting Officer*

*Acting Commissioner of Patents and Trademarks*